United States Patent [19]

Pollmeier et al.

[11] 4,062,309

[45] Dec. 13, 1977

[54] AUTOMATIC FEED DEVICE FOR SEWING MACHINE

[75] Inventors: Konrad Pollmeier, Bielefeld; Franz Hannemann, Pivitsheide VH, both of Germany

[73] Assignee: Durkoppwerke GmbH, Bielefeld, Germany

[21] Appl. No.: 632,100

[22] Filed: Nov. 14, 1975

[30] Foreign Application Priority Data

Nov. 14, 1974 Germany ..... 2454030

[51] Int. Cl.[2] ..... D05C 9/02

[52] U.S. Cl. ..... 112/121.15; 112/121.26

[58] Field of Search ..... 112/121.26, 121.15, 112/203, 207, 121.29

[56] References Cited

U.S. PATENT DOCUMENTS

| | | | |
|---|---|---|---|
| 2,444,335 | 1/1948 | Coppock | 112/121.15 |
| 3,463,101 | 8/1969 | Ansel | 112/121.15 |
| 3,713,408 | 1/1973 | Deeks et al. | 112/121.15 |
| 3,903,818 | 9/1975 | Marforio | 112/121.15 |

*Primary Examiner*—Werner H. Schroeder
*Assistant Examiner*—Peter Nerbun
*Attorney, Agent, or Firm*—Karl F. Ross

[57] ABSTRACT

A pair of tracks are pivotal and alignable with a stitching station of a sewing machine. Carried on each track is a clip which is normally biased away from the sewing machine but displaceable against the biasing force toward the stitching station. Each clip has a lower jaw swingable between an upper operative position and a lower return position and an upper jaw pivoted on the lower jaw and swingable between an upper open position, a lower operative position, and a third return position. In the return positions both of the jaws are below the plane of the support table adjacent the sewing machine. The trailing edge of a workpiece is clipped in one clip and the leading edge of the workpiece is fitted to the sewing station. As the clip approaches the sewing station it first automatically opens, then is automatically swung into the return position so that a workpiece whose trailing edge is held in the other clip can then pass over the returning clip to the sewing station.

8 Claims, 6 Drawing Figures

AUTOMATIC FEED DEVICE FOR SEWING MACHINE

FIELD OF THE INVENTION

The present invention relates to a feed device for a sewing machine. More particularly this invention concerns such a feed device as is used on a sewing machine having an automatic goods advance and a guide such as described in commonly assigned U.S. Pat. No. 3,913,507.

BACKGROUND OF THE INVENTION

A sewing machine is known having a sewing surface along which the workpiece passes through a sewing station. A fixed guide element has guide edge extending parallel to the workpiece path next to the station and a cover element spaced above the surface and displaceable between an operative position overlying the path and overhanging the guide edge to define with this guide edge and with this sewing machine workingsurface a guide slot, and an inoperative position lying outside the path in back of the guide edge. A pneumatic cylinder serves to displace this cover element between these two positions and is coupled to the sewing machine drive so that the cover element is in its operative position when the machine is operating at high speed but is displaced into an inoperative position when the machine is operated at low speed for precise stitching or loading. Such a machine is described in the above cited patent.

A feed device is known which has a clip that engages the side or back edge of a workpiece being pulled by the sewing machine workpiece advance through the stitching station. This clamp or clip serves to hold a pair of workpieces together and maintains the workpiece relatively taut between the sewing station and the trailing edges of the workpieces. It is known to provide a single clip that grips the trailing edge of the workpiece, or a plurality of clips which engage the sides and/or trailing edges.

Such arrangements all have the considerable disadvantage that the attachment of the workpiece to be stitched to the clip or clips is z relatively time-consuming operation. In addition between subsequent stitching operations the necessary time to load in another workpiece is relatively long. Furthermore, such feed devices are often relatively complicated and difficult to master for the sewing-machine operator.

OBJECTS OF THE INVENTION

It is therefore an object of the present invention to provide an improved sewing-machine feed apparatus.

Another object is the provision of such an apparatus which can be operated at high speed so as virtually to feed the workpieces in close succession eliminating resetting time.

SUMMARY OF THE INVENTION

These objects are attained according to the present invention in a feed device having a pair of elongated tracks extending next to and spaced from each other parallel to the transport direction of the sewing machine with which the device is used. Means is provided for displacing the tracks transversely to this direction between a pair of end positions each corresponding to alignment of one of the tracks with the sewing station. A clip is displaceable along each of the tracks and has a mouth open toward the station for gripping the trailing edge of a workpiece being advanced through the station. These clips are each urged in a direction away from the station to hold the workpieces taut. The tracks have upstream ends connected together by an element which is pivoted and the downstream ends are connected to an acutator so as pivotally to displace two tracks into the above-defined positions. The position of the pivot at the upstream ends of the tracks may also be displaced in order to set up the arrangement.

In accordance with further features of this invention each clip comprises a support displaceable along a respective track, a lower jaw pivoted on the support and having an upper face, and an upper jaw pivoted on the support and having a lower face engageable with the upper face of the lower jaw to clamp a workpiece edge. The upper jaw is pivotal relative to the lower jaw between an open operative position with its lower face spaced above the upper face of the lower jaw and a closed operative position wherein the lower face is juxtaposed with and clamping a workpiece with the upper face of the lower jaw, and this upper jaw is also displaceable into a return position lying below a plane extending above the tracks. In addition the lower jaw is displaced between an operative position with its upper surface generally parallel to and on the above-described plane and a return position with the lower jaw fully below the plane. Means is provided for displacing the upper jaw from the closed operative position into the open operative position when the respective clip arrives at a predetermined position adjacent the sewing station so as to release the workpiece. Means is also provided for displacing the upper and lower jaws into the return positions on displacement of the support back away from the sewing station. Thus, in accordance with the invention, the clip as it approaches the end of its track and the sewing station automatically opens and releases the workpiece, then pivots down below the plane of travel of the workpiece as it moves backwardly so that a following workpiece may travel to the stitching station without being interfered with by the returning clip. This is achieved in part, according to the present invention, by pivoting the upper jaw on the lower jaw so that a displacement of the lower jaw into the return position automatically displaces the upper jaw also into its return position.

According to another feature of this invention, a stop is provided on each of the tracks defining a back position for each of the clips spaced from the station. A reset means is provided on each track for displacing the lower jaw and the upper jaw of the respective clip into the operative position and the open operative positions once the clip comes to rest against its stop.

According to yet another feature of the invention each of the tracks is provided with means for detecting the presence of the respective clip in the respective back position. Each of these detectors is connected to the reset means for the other clip for operating same so that each clip is only reset after the other clip is displaced out of its respective back position. This detector may be linked by control means to the actuator that aligns the tracks with the sewing stations so as automatically to ensure that the track with the sewing stations so as automatically to ensure that the track in use is aligned with the sewing station.

With the system according to the present invention it is possible for the operator to engage the leading edge of a workpiece in the sewing station, then clip its trailing edge in one of the clips, and allow the sewing operation to take place automatically. During this sewing operation the operator can clip the trailing edge of the next workpiece to be sewed in the free clip. As the trailing edge of the workpiece comes to the sewing station it will automatically be released by its clip which will then automatically swing down out of the way to allow the operator to place the leading edge of the same workpiece into the sewing station. The safety delay, which prevents the last-returned clip from being raised into the operative position until the other clip has been moved away from its back position, prevents the raising clip from pushing the workpiece out of the loaded clip and prevents jamming of the apparatus.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
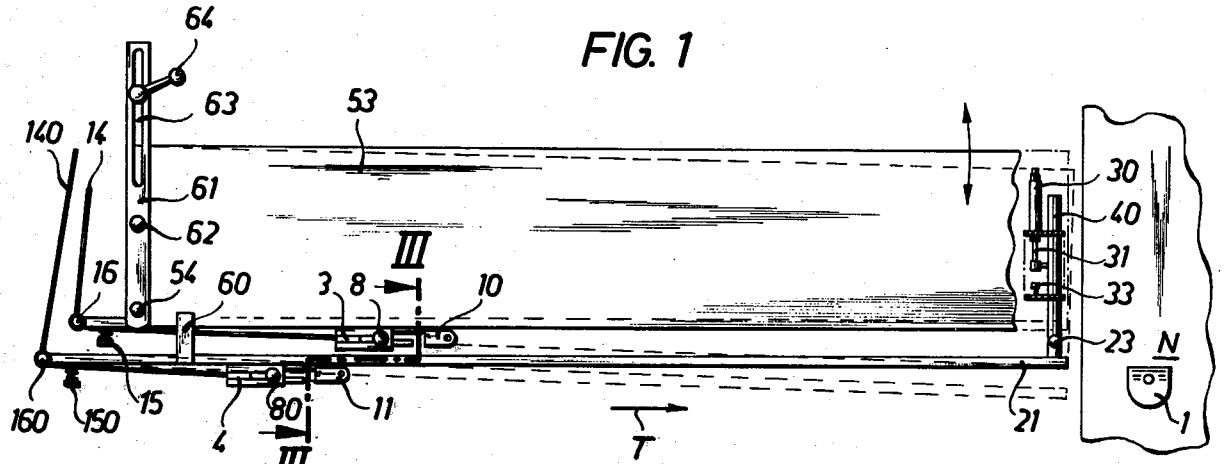
FIGS. 1 and 2 are top views illustrating the overall apparatus according to the present invention.

The apparatus according to this invention has a heavy wooden support table 50 (FIG. 3) intended to support workpieces 2 (FIG. 5) each having two parts, such as upper arm and under arm panels or the like, which are to be fed to a stitching station N (FIGS. 1 – 2) where they are united to a single piece. At this station N there is provided a feed dog 1 which is reciprocated in a manner known per se and similar to that described in the above-cited commonly assigned patent to advance the workpiece in the direction indicated by arrow T (FIG. 1). Before the operator feeds the leading edge of the workpiece into the advance device 1 at the station N he or she clamps the trailing edge in one of two clips 10 and 11 as will be described below.

Figure 2:
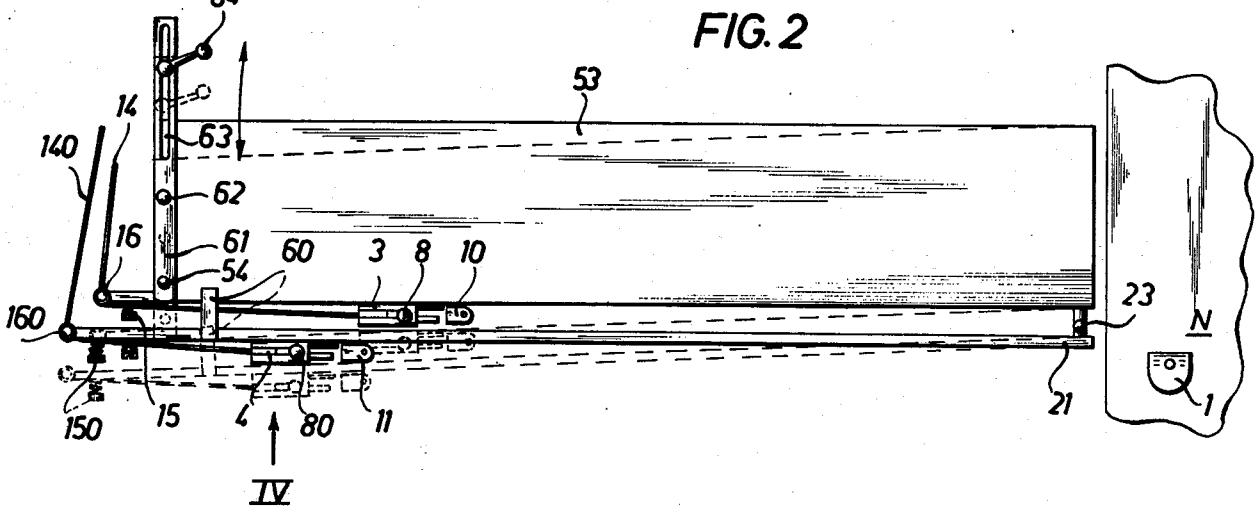
Figure 3:
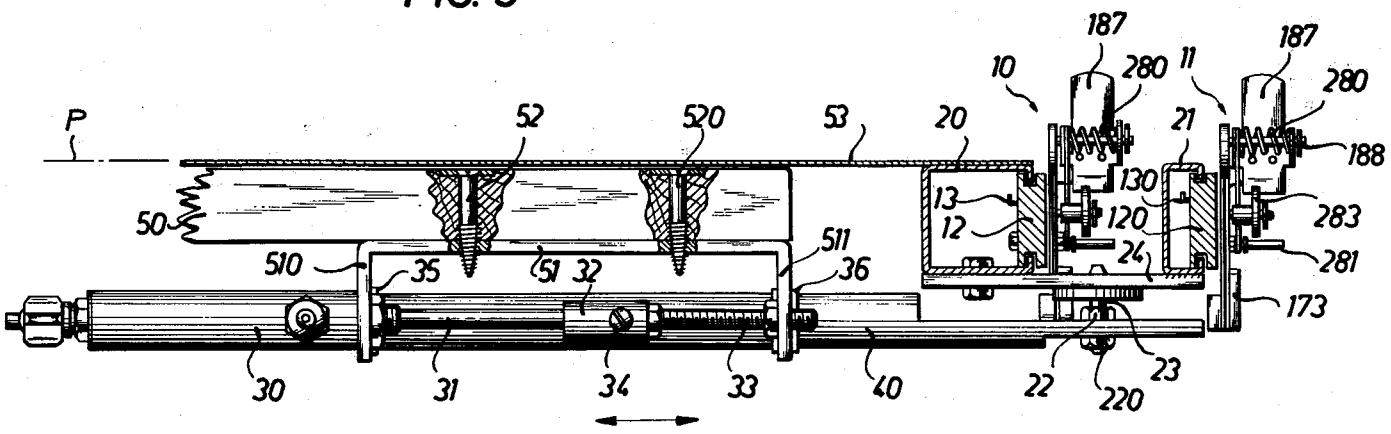
FIG. 3 is a section taken along line III—III of FIG. 1.

As shown in FIGS. 1-3 the clamps 10 and 11 ride in respective C-section tracks 20 and 21 next to one another generally in the direction T and can be displaced independently of one another. A U-shaped bracket 51 secured by means of machine screws 52 and 520 to the table 50 has a pair of bent-over end flanges 510 and 511. A pneumatic cylinder 30 is secured in the end 510 and has a piston rod 31 connected by a screw 34 to a coupling 32 engageable with a stop 33 secured in the other end 511 of bracket 51. A slider 40 is connected as best shown in FIG. 1 to the piston rod 31 at the coupling 32 and is guided by means of bushings 35 and 36 in the ends 510 and 511 of the bracket 51. This slider 40 is of cylindrical shape in the region slidable within the bearings 35 and 36 and has an end section secured to a pivot pin 23 by means of a pair of nuts 22 and 220.

The two tracks 20 and 21 are carried on a common plate 24, the track 20 being bolted to this plate 24 and the track 21, which is of a C-section like the track 20, being welded to this plate 24. The pivot 23 is engaged in the plate 24 so that operation of the double-acting pneumatic cylinder 30 can displace these tracks 20 and 21 between the positions indicated in solid and dashed lines respectively, in FIG. 1. Glued to the track 20 is a sheet-metal plate 53 lying on top of the support surface 50 and defining a support or sliding plane P for the workpieces 2. Each of the track positions aligns a respective path of a respective clip 10 or 11 directly with the stitching station N in the transport direction T. Thus if the workpiece is to be stitched in a straight line the appropriate location at one end of the workpiece need merely be fed into the stitching station and the opposite end of the line along which the stitching is to be made is clipped in the one clip 10 or 11 so as to ensure that a straight line of stitching is produced between these two locations.

These tracks 20 and 21 are connected together at their upstream ends by means of a slidable plate 61 defining a pivot axis 43 for the plate 53. This plate 61 has a handle 62 and is formed with a slot 63 in which is provided a lockable nut 64 that can secure the plate 61 in any of a plurality of positions so as to adjust the location of the pivot 54 transverse to the direction T. The tracks 20 and 21 to this end are secured together adjacent their upstream ends by means of a plate 60 welded to the plate 53. The cylinder 30 is therefore able to pivot the plate 53 and the tracks 20 and 21 through an angle of approximately 5° about the pivot 54. The pivot pin 23 may engage in a short slot formed in the element 24 and extending in the direction of arrow T to compensate for the arcuate path of travel of the ends of the guides 20 and 21 and the straight-line travel of the pin 23.

Figure 6:
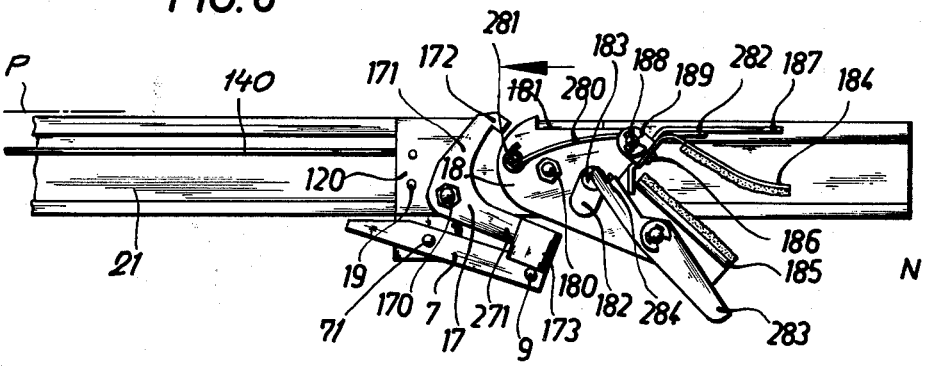

The clips 10 and 11 as shown in FIGS. 3 and 6 are mounted on respective support blocks 12 and 120 slidable between the ridges of the C-section guides 20 and 21. Theseblocks 12 and 120 are provided with respective cable clips 13 and 130 connected as shown in FIGS. 1 and 2 to respective cables 14 and 140 passing through nut-type tensioning devices 15 and 150 and over deflecting rollers 16 and 160 and provided at their ends with weights riding vertically in tubes so as normally to pull the supports 12 and 120 back opposite the direction T and against respective end stops 3 and 4 secured in place by means of adjustment screws 8 and 80. These end stops 3 and 4 are shown staggered relative to one another in FIGS. 1 and 2 for the sake of clarity of view, but in normal use are exactly opposite one another.

Figure 4:
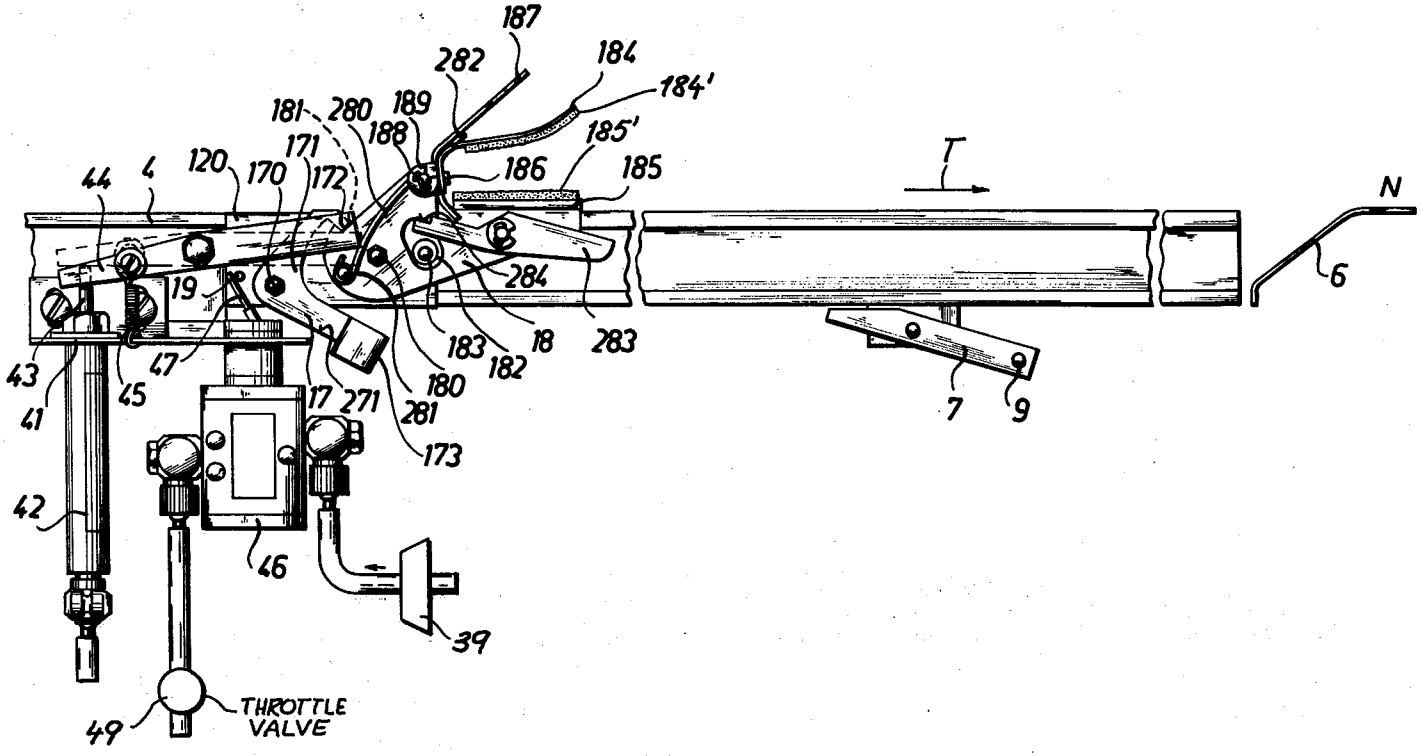
FIG. 4 is a view taken in the direction of arrow IV of FIG. 2, and FIGS. 5 and 6 are views similar to FIG. 4 illustrating the clip of FIG. 4 in different positions.
Figure 5:
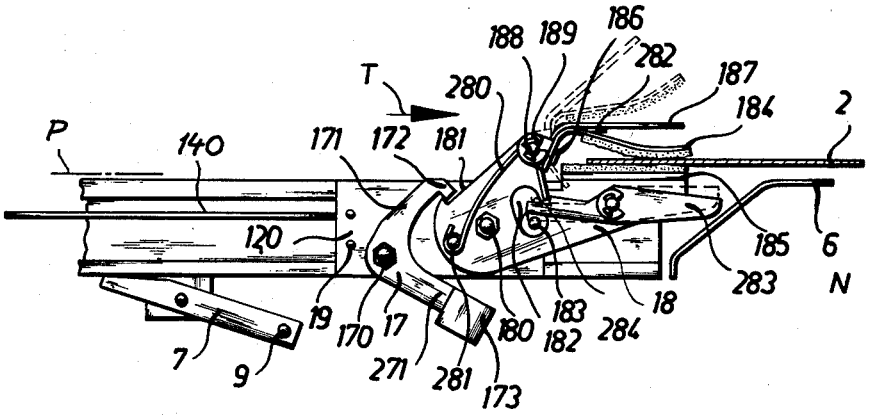

Clamp 10 shown in FIGS. 4, 5 and 6 is identical to clamp 11. This clamp 10 has a support block 120 provided with two pivots 170 and 180 extending parallel to each other and perpendicular to the transport direction T. A two-armed actuating lever 17 on the pivot 170 coacts with a clamp lever 18 on the pivot 180 so as to maintain it in an operative position shown in FIGS. 4 and 5 or allow it to clip to pivot into a return position shown in FIG. 6. The lever 17 has an upper arm 171 formed at its end with a downwardly directed tooth 172 engageable in a notch 181 formed in the upper side of the jaw lever 18 as shown in FIGS. 4 and 5. The lower lever arm 271 carries a weight 173 which is welded in place and serves to urge the lever 17 rotationally in a clockwise direction as seen in FIGS. 4-6 about its pivot 170 thereby pushing the nose 172 into the notch 181. The support arm 18 is limitedly pivotal about its support 180, having an arcuate slot 182 centered on the pivot 180 and receiving a pin 183 which in the operative position seats in the bottom of the cutout 182 and in the return position in the top of the cutout 182.

The element 18 also pivotally supports on upper jaw 184 engageable against a lower jaw 185 carried directly on the lower arm of the element 18. The jaw 185 lies generally in the plane P in the operative position of FIGS. 4 and 5 and well below this plane P in the return position of FIG. 6. Both the jaw 185 and jaw 184 are covered with a cushioning layer 184' and 185' serving to increase the coefficient of friction between these jaws and the workpiece and to prevent the jaws from marking the workpiece.

The displaceable upper jaw 184 is formed as an upwardly concave spring-steel plate secured by means of a screw 186 to an arm 187 pivotal about a pin 188 on the element 18 parallel to the pivot 180. A torsion spring 186 wound around the pin 188 (see FIG. 3) has one end wrapped around a pin 281 and another end pressing at 282 upwardly against the plate 187 serving to urge it upwardly, that is in a counterclockwise direction to urge the jaw 184 away from the jaw 185. A snap ring 189 on the end of the pin 188 holds the plate 187 and the spring 186 thereon. Thus the spring 186 urges the jaw 184 into the open position shown in FIGS. 4 and 6.

Below the jaws 184 and 185 is a two-armed locking pawl 283 whose right-hand arm is heavier than its left-hand arm so that it is normally urged rotationally clockwise. The rear end of this pawl 283 is formed with a notch 284 in which the end of the jaw lever 187 engage so as to hold the jaw 184 in the closed position indicated in FIG. 5.

Adjacent the stitching station N there is provided an upwardly inclined actuating ramp 6 that is engageable with the leading end of the lever 283 so as to pivot it upwardly as shown in dashed lines in FIG. 5 and thereby free the end of the element 187, thereby allowing the jaw 184 to pivot up under the action of the spring 186 and free the workpiece 2 when this clip comes to a forward position adjacent the station N.

As soon as the workpiece 2 has been released the tension in the cable 140 pulls the support block 120 backwardly. At the initiation of the backward movement the elements will be in the position shown in FIG. 4. Immediately upstream of the station N, however, there is provided an actuating lever 7 secured to the guide 21 (see FIGS. 5 and 6) and pivotal under this track 21 about a fixed pivot axis71. The downstream arm of the lever 7 is substantially heavier than the upstream arm so that this downstream arm normally hangs below the upstream arm as indicated in FIG. 5 with the upstream arm bearing against the underside of the track 21. In addition the downstream arm carries a laterally extending pin 9 engageable with the weight 173. As the support 120 moves in the direction T the weight 173 will reach with its leading edge under the pin 9 and pivot it upwardly, displacing only the lever 7. On backward travel, however, the leading edge of the underside of the weight 173 will strike against the top of the pin 9 and, since the lever 7 cannot be rotated clockwise as its other end bears underneath the track 21, this will cam up the lever 17 and pull the tooth 172 out of the notch 181. The weight of the lever 18 to the right of its pivot 180 is considerably greater than its weight to the left so that this lever 18 will then pivot into the return position illustrated in FIG. 6, with both of the jaws 184 and 185 lying well below the plane P. When in the return position illustrated in FIG. 6 the clip 11 can pass back along its track 21 underneath an advancing workpiece 2 held by the other clip 10.

Carried on the stop 4 is a mechanism as illustrated in FIG. 4 which includes a lever 44 pivotal about a horizontal axis perpendicular to the track 21 and having a downstream end engageable with the pin 281 on the element 18. The other end of this lever 44 is engaged by the piston rod 43 of a pneumatic cylinder 42 screwed at 41 to a bracket on the stop 4 so that pressurization of this cylinder will force the lever 44 up against the force of a spring 45 connected between the stop 4 and the left-hand arm of the lever 44 and pivot the element 18 into the operative position. In addition the stop 4 carries a valve 46 connected between a compressor 39 and a throttle valve 49 and carrying an arm 47 deflectable by a pin 19 carried on the support block 120. When the arm 47 is pushed to the side as shown in FIG. 4 the valve 4 is closed and prevents air flow between the compressor 39 and the throttle valve 49. This throttle valve 49 is connected to the cylinder 42 of the other clip 10 and the cylinder 42 of the clip 11 is connected to the throttle valve 49 of the other clip 10.

Thus whenever a clip moves into its back position, as illustrated in FIG. 4, it closes off air flow to the cylinder 42 of the other clip and prevents this clip from being displaced into its operative position until it moves away and releases the pin 47. Thus if one of the pins is in its return position as illustrated in FIG. 6 and the other in its operative position as illustrated in FIG. 4 and both of these clips 10 and 11 are against their respective stops 3 and 4 the operator can load the edge of a workpiece to be stitched into the open clip and press it manually closed. The operator then fits the leading edge of the workpiece into the stitching device and the drive of the stitching arrangement automatically pulls the workpiece along, thereby displacing the one clip away from its stop. As soon as this clip is displaced away from its stop its valve is opened and, after a suitable delay determined by the setting of the respective throttle valve 49, the cylinder 42 of the other clip is operated to bring this other clip up into the operative position.

The operator can then fit the trailing end of another workpiece into the clip which was just lifted up above the plane P and, once the previous workpiece has been finished stitching he or she may load the leading edge of this newly loaded workpiece into the stitching device. Before the next workpiece has been stitched sufficiently to pull the clip holding its trailing edge away from its stop the other clip will have returned to the back position so that when the next clip is pulled away from its stop the corresponding cylinder 42 will be operated to swing it up into the operative position. Therefore the operator can work continuously, with the pauses between the subsequent stitching operations being almost fully eliminated since as one clip is moving forward and one workpiece is being stitched the operator can be loading the trailing edge of the next workpiece into the next clip.

It is noted that in conjunction with the operation of the two cylinders 42, the cylinder 40 is operated in order to align the proper guide with the stitching station N. To this end the valve 46 of the clip 10 is connected to the cylinder 40 which is spring loaded. Furthermore it is possible to provide a photocell detecting device to start and stop the stitching the instant the device senses that the trailing edge of the workpiece that has just been stitched passes beyond the needle feed 1. In this case the stitching machine will also start up again automatically the instant the leading edge of another workpiece is inserted in this location. The stops 3 and 4 are adjusted such that the distance between the clips 10 and 11 on one side and the stitching station N on the other is slightly longer than the overall workpiece length so as to keep these workpieces relatively taut.

We claim:

1. In combination with a sewing machine having means for advancing a workpiece to be stitched in a transport direction through a sewing station:

a pair of elongated tracks extending next to and spaced from each other parallel to said direction;

means for displacing said tracks transversely to said direction between a pair of end positions;

a clip displaceable along each of said tracks and having means defining a mouth open toward said station for gripping the trailing edge of a workpiece being advanced through said station;

means for urging each of said clips in a direction away from said station to hold workpieces engaged by said clips taut, said tracks having downstream ends adjacent said station and upstream ends remote from said station; and an element connecting said tracks rigidly together at said upstream ends and provided with a pivot transverse to said direction, said means for displacing including an actuator engaging said downstream ends for swinging said tracks about said pivot, said tracks lying generally below a support plane, each of said clips comprising:

a support displaceable along the respective track, a lower jaw pivoted on said support and having an upper face and displaceable between an operative position with said face generally parallel to and on said plane and a return position with said jaw below said plane, an upper jaw pivoted on said support and having a lower face and displaceable between an open operative position with said upper jaw above said plane and said lower face spaced above said upper face, a closed operative position with said upper jaw above said plane and said lower face juxtaposed with and clamping a workpiece with said upper face, and a return position with said upper jaw below said plane, means for displacing said upper jaw from said closed operative position into said open operative position on approaching a predetermined position adjacent said station for releasing said workpiece, and means for displacing said upper and lower jaws into said return position on displacement of said support back away from said station.

2. The combination defined in claim 1 wherein said actuator is a fluid-operated cylinder.

3. The combination defined in claim 1 wherein said tracks have an element connecting together said downstream ends and provided with a pivot connected to said actuator, said combination further comprising means for displacing the pivot at said upstream end transversely to said direction.

4. The combination defined in claim 1 wherein each upper jaw is pivoted on the respective lower jaw and said means for displacing said jaws includes abutments nondisplaceable along said tracks and adjacent said station.

5. The combination defined in claim 1, further comprising a stop on each of said tracks defining a back position for each of said clips spaced from said station and including reset means on each track for displacing said lower jaw and said upper jaw of the respective clip into said operative position and said open operative position, respectively, on arrival of the respective clip in its respective operative position.

6. The combination defined in claim 5 wherein each of said tracks is provided with means for detecting the presence of the respective clip in the respective back position and connected to the other reset means for operation thereof so that each clip is only reset when the other clip is displaced out of its respective back position.

7. The combination defined in claim 5 wherein each upper jaw is pivoted on the respective lower jaw and each clip includes means for pivotally biasing said lower jaw into said return position, each reset means including an actuator engageable with the respective lower jaw for displacement thereof into said operative position.

8. The combination defined in claim 7 further comprising control means between said detector means and said actuator of said actuator engaging said downstream ends for aligning with said sewing station the track of the clip which has just moved out of its said back position.

* * * * *